US012070085B2

(12) United States Patent
Liu

(10) Patent No.: US 12,070,085 B2
(45) Date of Patent: Aug. 27, 2024

(54) BRASSIERE CUP STRUCTURE, MANUFACTURING METHOD THEREOF AND UNDERWEAR CONTAINING THE SAME

(71) Applicant: REGINA MIRACLE INTERNATIONAL (GROUP) LIMITED, Hong Kong (CN)

(72) Inventor: Zhenqiang Liu, Hong Kong (CN)

(73) Assignee: REGINA MIRACLE INTERNATIONAL (GROUP) LIMITED, Hongkong (CN)

( * ) Notice: Subject to any disclaimer, the term of this patent is extended or adjusted under 35 U.S.C. 154(b) by 0 days.

(21) Appl. No.: 17/640,335

(22) PCT Filed: Jan. 19, 2021

(86) PCT No.: PCT/CN2021/072588
§ 371 (c)(1),
(2) Date: Jul. 28, 2022

(87) PCT Pub. No.: WO2022/155761
PCT Pub. Date: Jul. 28, 2022

(65) Prior Publication Data
US 2024/0108082 A1 Apr. 4, 2024

(51) Int. Cl.
*A41C 3/00* (2006.01)

(52) U.S. Cl.
CPC ..... *A41C 3/0007* (2013.01); *A41C 3/0085* (2013.01)

(58) Field of Classification Search
CPC ..... A41C 3/0007; A41C 3/0085
See application file for complete search history.

(56) References Cited

U.S. PATENT DOCUMENTS

| | | | | |
|---|---|---|---|---|
| 10,609,966 | B2 * | 4/2020 | Huffa | A41C 3/0057 |
| 11,470,889 | B2 * | 10/2022 | Huffa | A41C 3/126 |
| 11,758,954 | B2 * | 9/2023 | Huffa | A41C 3/0057 450/1 |

(Continued)

FOREIGN PATENT DOCUMENTS

| | | | |
|---|---|---|---|
| CN | 102742943 | A | 10/2012 |
| CN | 107713038 | A | 2/2018 |
| CN | 107734985 | A | 2/2018 |

(Continued)

*Primary Examiner* — Gloria M Hale
(74) *Attorney, Agent, or Firm* — Birchwood IP

(57) ABSTRACT

This application relates to an improved brassiere cup structure, which includes a brassiere cup body, the brassiere cup body includes an outer surface layer and an inner surface layer, the brassiere cup body at least includes a breast supporting part and a lower cling part; at a junction of the breast supporting part and the lower cling part, at least a part of the outer surface layer forms a hollow window area, and the inner surface layer covers the window area, so that a thin and light heat dissipation structure is formed at the window area, at the same time has the characteristics of good air permeability, in addition, the window area allows the breast supporting part and the lower cling part to move relative to each other, so that when the breast is displaced, the shape can be changed adaptively, thereby improving the comfort of the wearer.

10 Claims, 3 Drawing Sheets

(56) References Cited

U.S. PATENT DOCUMENTS

2016/0360801 A1* 12/2016 Sze ..... A41D 31/185

FOREIGN PATENT DOCUMENTS

| | | | |
|---|---|---|---|
| CN | 207285219 | U | 5/2018 |
| CN | 108471815 | A | 8/2018 |
| CN | 109662355 | A | 4/2019 |
| CN | 110771962 | A | 2/2020 |
| CN | 110881713 | A | 3/2020 |
| CN | 211021021 | U | 7/2020 |
| EP | 3087854 | A1 | 11/2016 |

* cited by examiner

BRASSIERE CUP STRUCTURE, MANUFACTURING METHOD THEREOF AND UNDERWEAR CONTAINING THE SAME

TECHNICAL FIELD

This application relates to the field of underwear manufacturing, and more particularly to an improved brassiere cup structure, a manufacturing method thereof, and an underwear containing the same.

BACKGROUND

In the related technology, the brassiere cup is a brassiere component formed into a certain shape and used to support the breast, therefore, most of the brassiere cups are sheet-like structures with a larger area, and generally, only a certain gap is formed between the bottom of the lower cling part and the brassiere cup mouth for air permeability, and a thicker structure is integrally formed between the lower cling part and the breast supporting part. Taking into account the characteristics of the human chest, the fit between the lower part and the breast supporting part is often close, and the lower part is wrapped on the two ribs, the breast is attached to the breast supporting part under the action of gravity, so users will feel a sense of restraint at this part often, especially when the weather is hot, the users will feel the accumulation of sweat.

Therefore, it is necessary to propose a new improved structure of the brassiere cup to overcome the shortcomings in the existing technology.

SUMMARY

In order to overcome the problems in related technologies, an improved brassiere cup structure is provided in this application, which includes a brassiere cup body, the brassiere cup body includes an outer surface layer and an inner surface layer, the brassiere cup body at least includes a breast supporting part and a lower cling part; at a junction of the breast supporting part and the lower cling part, at least a part of the outer surface layer forms a hollow window area, and the inner surface layer covers the window area.

Preferably, the window area is a continuous arc-shaped area close to the breast supporting part, so that the brassiere cup body has: the breast supporting part can move in the window area relative to the lower cling part.

Preferably, the inner surface layer corresponding to the window area is made of mesh cloth or knitted cloth.

Preferably, further includes a shaping strip arranged at a position below the window area.

Preferably, the shaping strip is made of a flexible material, and the shaping strip is sandwiched between the outer surface layer and the inner surface layer, or buried inside the outer surface layer.

Preferably, further includes an outer lining cloth layer covering the outer surface layer of the brassiere cup body.

Preferably, a plurality of air holes are provided on the outer surface layer.

A manufacturing method of a brassiere cup, which includes: manufacturing a brassiere cup prototype, and at a junction of a breast supporting part and a lower cling part, removing a certain thickness of material on an outer side of the breast brassiere cup prototype by material removal processing to obtain the improved brassiere cup structure of any one of the above.

A manufacturing method of a brassiere cup, which includes: manufacturing a brassiere cup prototype, and at a junction of a breast supporting part and a lower cling part, cutting the brassiere cup prototype by material removal processing to obtain an outer surface layer, then combining the outer surface layer and an inner surface layer of an elastic cloth to obtain the improved brassiere cup structure of any one of the above.

An underwear, which includes the improved brassiere cup structure of any one of the above.

It should be understood that the above general description and the following detailed description are only exemplary and explanatory, and cannot limit the application. According to the scheme of the present invention, an improved brassiere cup structure is provided, which includes a brassiere cup body, the brassiere cup body includes an outer surface layer and an inner surface layer, the brassiere cup body at least includes a breast supporting part and a lower cling part; and at a junction of the breast supporting part and the lower cling part, at least a part of the outer surface layer forms a hollow window area, and the inner surface layer covers the window area, so that a light and thin heat dissipation structure is formed in the window area, and at the same time it has the characteristics of good air permeability, in addition, the window area allows the breast supporting part and the lower cling part to move relative to each other, so that when the breast is displaced, the shape can be changed adaptively, thereby improving the comfort of the wearer.

BRIEF DESCRIPTION OF DRAWINGS

The exemplary embodiments of the present application are described in more detail with reference to the accompanying drawings, the above and other purposes, features and advantages of this application will become more apparent, in which, in the exemplary embodiments of the present application, the same reference numerals generally represent the same components.

Figure 1:
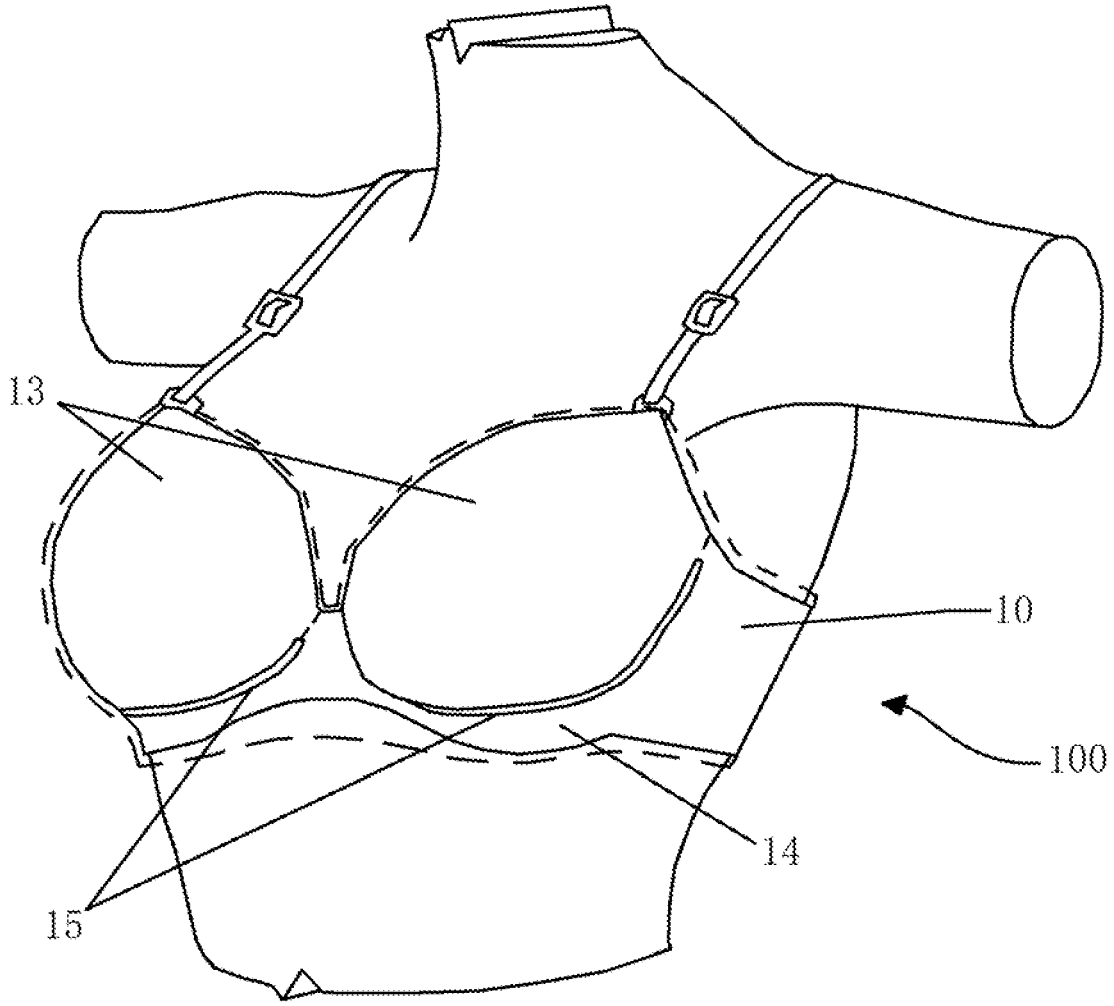
FIG. 1 is a schematic diagram of a brassiere with an improved brassiere cup structure according to an embodiment of the present application.

The corresponding meanings of the reference numerals in the figures are as follows:

| | | | |
|---|---|---|---|
| 100 | improved brassiere cup structure | 14 | lower cling part |
| 10 | brassiere cup body | 15 | window area |
| 11 | outer surface layer | 16 | shaping strip |
| 12 | inner surface layer | 17 | air hole |
| 13 | breast supporting part | 20 | outer lining cloth layer |

DETAILED DESCRIPTION

Hereinafter, the preferred embodiments of the present application will be described in more detail with reference to the accompanying drawings. Although the preferred embodiments of the present application are shown in the drawings, it should be understood that the present application can be implemented in various forms and should not be limited by the embodiments set forth herein. On the contrary, these embodiments are provided to make this application more thorough and complete, and to fully convey the scope of this application to those skilled in the art.

The terms used in this application are only for the purpose of describing specific embodiments, and are not intended to limit the application. The singular forms of "a", "the" and "said" used in this application and the appended claims are also intended to include plural forms, unless the context clearly indicates other meanings. It should also be understood that the term "and/or" as used herein refers to include any or all possible combinations of one or more associated listed items.

It should be understood that although the terms "first", "second", "third", etc. may be used in this application to describe various information, the information should not be limited to these terms. These terms are only used to distinguish the same type of information from each other. For example, without departing from the scope of this application, a first information may also be referred to as second information, and similarly, a second information may also be referred to as first information. Therefore, the features defined with "first" and "second" may explicitly or implicitly include one or more of the features. In the description of the present application, "a plurality of" means two or more than two, unless otherwise specifically defined.

In the description of this application, it should be understood that the position or position relationship indicated by the terms "length", "width", "upper", "lower", "front", "rear", "left", "right", "vertical", "horizontal", "top", "bottom", "inside", "outside" is based on the position or position relationship shown in the drawings, it is only for the convenience of describing the application and simplifying the description, rather than indicating or implying that the device or element referred to must have a specific orientation, be constructed and operated in a specific orientation, and therefore cannot be understood as a limitation of the application.

Unless otherwise clearly specified and limited, the terms "mount", "connected with", "connected to", "fixed" and other terms should be understood in a broad sense, for example, it can be a fixed connection, a detachable connection, or formed in one-piece; it can be a mechanical connection or an electrical connection; it can be a direct connection or an indirect connection through an intermediate medium, and it can be a connection between two components or an interaction relationship between two components. For those of ordinary skill in the art, the specific meanings of the above terms in this application can be understood according to specific circumstances.

An improved brassiere cup structure 100 is provided, which includes a brassiere cup body 10, the brassiere cup body 10 includes an outer surface layer 11 and an inner surface layer 12, the brassiere cup body at least includes a breast supporting part 13 and a lower cling part 14; at a junction of the breast supporting part 13 and the lower cling part 14, at least a part of the outer surface layer 11 forms a hollow window area 15, and the inner surface layer 12 covers the window area 15. So that a thin and light heat dissipation structure is formed at the window area, at the same time has the characteristics of good air permeability, in addition, the window area allows the breast supporting part and the lower cling part to move relative to each other, so that when the breast is displaced, the shape can be changed adaptively, thereby improving the comfort of the wearer.

Embodiment 1

Figure 2:
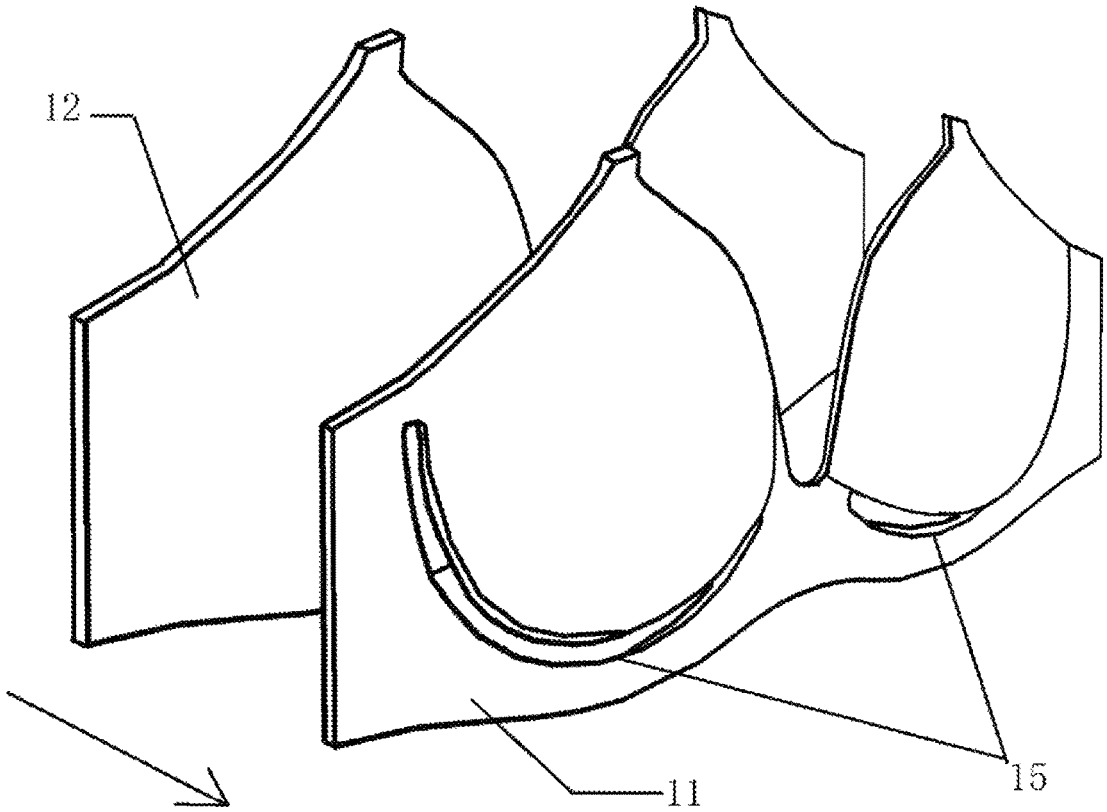
FIG. 2 is a schematic diagram of an improved brassiere cup structure according to an embodiment of the present application.

As shown in FIG. 1 and FIG. 2, an improved brassiere cup structure 100 is provided, which includes a brassiere cup body 10, the brassiere cup body 10 includes an outer surface layer 11 and an inner surface layer 12, the brassiere cup body at least includes a breast supporting part 13 and a lower cling part 14; at a junction of the breast supporting part 13 and the lower cling part 14, at least a part of the outer surface layer 11 forms a hollow window area 15, and the inner surface layer 12 covers the window area 15. So that a thin and light heat dissipation structure is formed at the window area 15, at the same time has the characteristics of good air permeability, the inner surface layer 12 can be made of elastic cloth, which has good elasticity and wrapping feeling, and the outer surface layer 11 can be made of foam sponge, silica gel and other materials with a certain shaping effect, the window area 15 is a continuous arc-shaped area close to the breast supporting part 13. Therefore, the breast supporting part 13 can move relative to the lower cling part 14 in the window area 15. Further, in addition to enhancing the air permeability, the window area 15 allows the breast supporting part and the lower cling part to move relative to each other, and through the elasticity and deformation of the cloth in the window area 15, for different body shapes, sizes of the breasts and sizes of the left and right breasts, have a certain function of adjusting the size of the brassiere cup, so that when the breast is displaced, it can change the shape adaptively to the shape change, therefore, the comfort of the wearer is improved, and the brassiere cup body 10 can adapt to the change of the wearer's breast shape to a certain extent.

Embodiment 2

Figure 3:
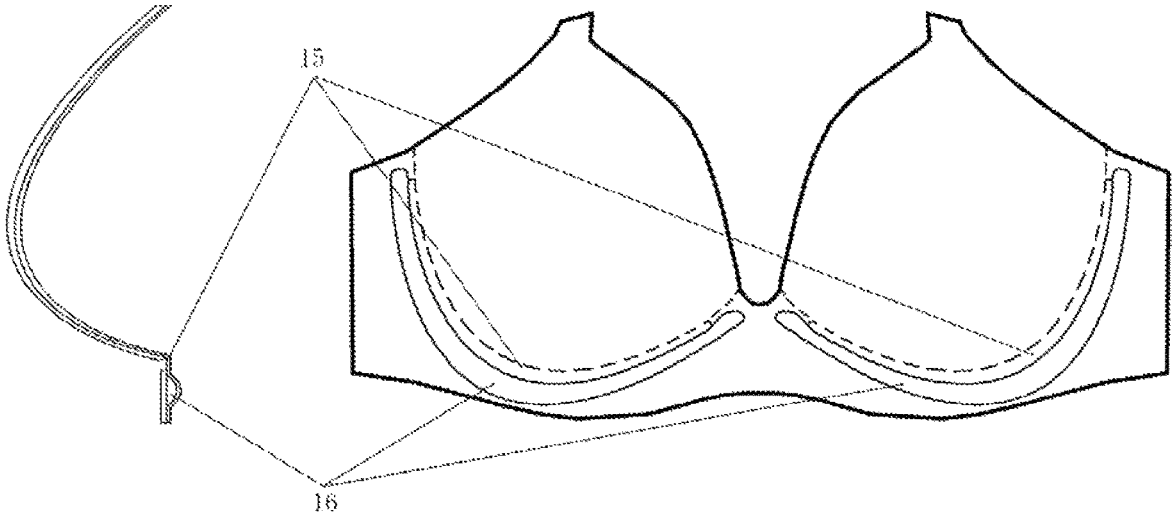
FIG. 3 is a schematic diagram of an improved brassiere cup structure with a shaping strip according to an embodiment of the present application.

As shown in FIG. 3 of the accompanying drawings, the brassiere cup body 10 further includes a shaping strip 16 which is arranged at a position below the window area 15. In this embodiment, the shaping strip 16 is flexible silica gel, and the shaping strip 16 is sandwiched between the outer surface layer 11 and the inner surface layer 12. Similarly, the shaped strip 16 can also be a steel ring structure buried inside the outer surface layer 11, thus to achieve the effect of gathering the breast, at the same time, it provides a certain structural strength for the window area 15, thereby having a good air permeability or can be deformed adaptively. The shaping strip 16 can be made of flexible silica gel, nylon material, thermoplastic rubber material (TPR/TPE), styrene block copolymer (SEBS), thermoplastic polyester elastomer (TPEE), thermoplastic polyurethane elastomer rubber (TPU) and other thermoplastic materials, webbing rubber roots, compressed cotton slivers and other materials.

Embodiment 3

Figure 4:
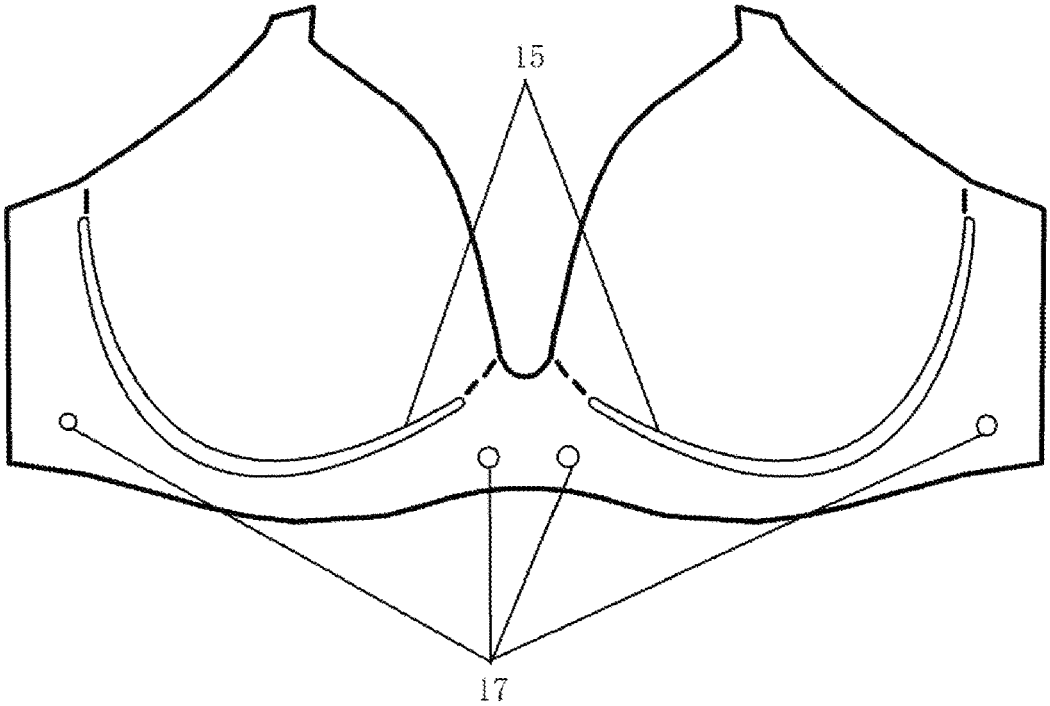
FIG. 4 is a schematic diagram of a brassiere cup body with air holes according to an embodiment of the present application.

As shown in FIG. 4 of the accompanying drawings, the outer surface layer 11 of the brassiere cup body 10 is provided with a plurality of air holes 17 to realize the rapid flow of air, thereby achieving the effects of rapid circulation and sweat discharging. Optionally, the diameter of the air hole is 0.1 mm-5 mm, so as to achieve a better somatosensory contact effect and underwear shaping effect, while improving the air permeability. The inner surface layer 12 can also be made of mesh cloth or knitted cloth, which provides good air permeability while providing elasticity, and can enhance the air flow in the window area.

Embodiment 4

Figure 5:
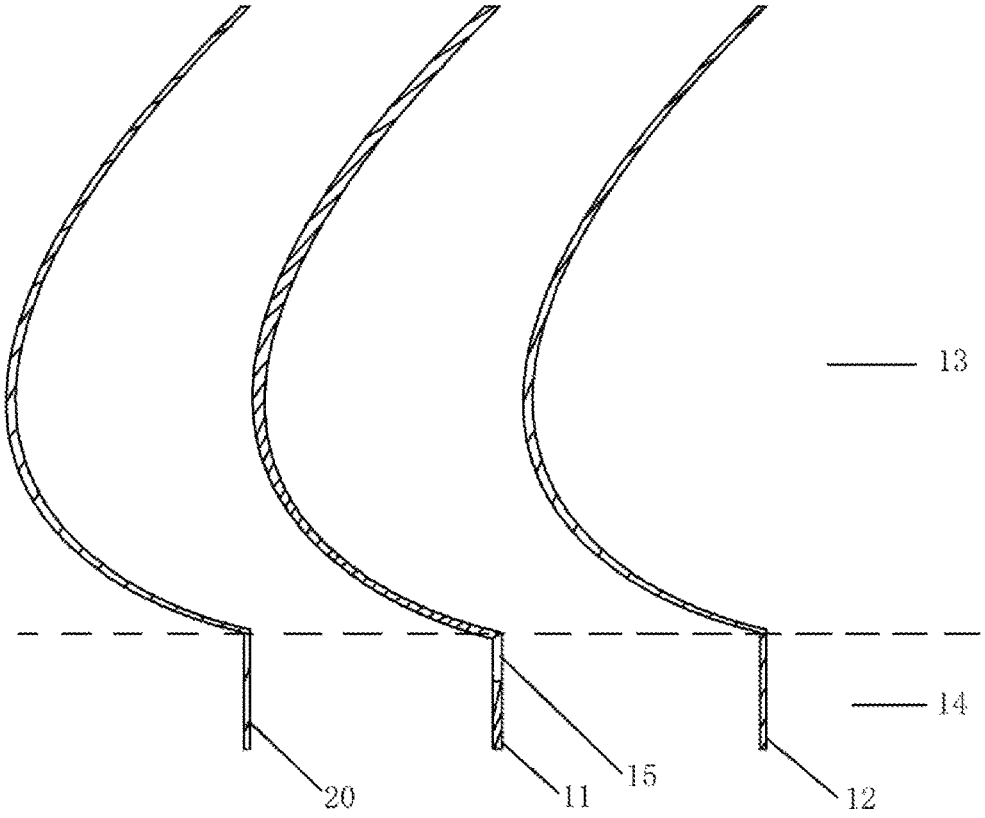
FIG. 5 is a schematic diagram of a brassiere cup body with an outer lining cloth layer according to an embodiment of the present application.

As shown in FIG. 5 of the drawings, the brassiere cup body 10 further includes an outer lining cloth layer 20 covering the outer surface layer 11 of the brassiere cup body. The outer surface layer 11 is clamped by the outer lining cloth layer 20 and the inner surface layer 12, thereby fixing the outer surface layer 11 and compressing the thickness of the outer surface layer 11, and thereby making the surface of the brassiere cup body 10 smoother and flatter.

Similarly, the brassiere cup body can also be made of one of latex, silica gel, TPU and EVA, or a variety of materials are formed by hot pressing, injection molding, sticking or other methods to manufacture the cup body, which will not be repeated here, and the technical solutions formed by combining with the technical solutions disclosed in this patent are all within the protection scope of this patent.

The method of manufacturing any of the above-mentioned brassiere cup structures includes: manufacturing a brassiere cup prototype, and at a junction of a breast supporting part 13 and a lower cling part 14, removing a certain thickness of material on an outer side of the breast brassiere cup prototype by material removal processing to obtain the improved brassiere cup structure 100 as described above. In this method, hot pressing or glue sealing is performed first, and thereby the integrated shape being more natural and uniform.

In another manufacturing method, includes: manufacturing a brassiere cup prototype, and at a junction of a breast supporting part 13 and a lower cling part 14, cutting the brassiere cup prototype by material removal processing to obtain an outer surface layer 11, then combining the outer surface layer 11 and an inner surface layer 12 of an elastic cloth to obtain the improved brassiere cup structure 100 as described in any one of the above. As shown in FIG. 2 or FIG. 5 of the attached drawings, the dispersed structures are produced, and then are combined through effects such as hot pressing and plastic sealing.

As shown in FIG. 1, the brassiere cup structure described above can be used to produce underwear, the underwear includes any one of the above-mentioned improved brassiere cup structure 100, and external cord buckles, rings or integrally formed elastic fabrics and other processes and methods are used to produce sports bras, breathable underwear, breathable clothing next to the skin, and other products, which will not be repeated one by one here, the technical solutions formed by combining with the technical solutions disclosed in this patent are all within the protection scope of this patent.

The embodiments of the present application have been described above, and the above description is exemplary, not exhaustive, and is not limited to the disclosed embodiments. Without departing from the scope and spirit of the described embodiments, many modifications and changes are apparent to those of ordinary skill in the art. The terms used herein is intended to best explain the principles, practical applications, or improvements to the technology in the market for each embodiment, or to enable those of ordinary skill in the art to understand the various embodiments disclosed herein.

What is claimed is:

1. A brassiere cup structure, comprising a brassiere cup body, the brassiere cup body comprises an outer surface layer and an inner surface layer, wherein the brassiere cup body at least comprises a breast supporting part and a lower cling part; at a junction of the breast supporting part and the lower cling part, at least a part of the outer surface layer forms a hollow window area, and a part of the inner surface layer covers the window area;

wherein the window area is a continuous arc-shaped area close to the breast supporting part, so that the breast supporting part can move in the window area relative to the lower cling part;

wherein the brassiere cup structure further comprises a shaping strip arranged at a position below the window area, the shaping strip is embedded in the outer surface layer.

2. The brassiere cup structure of claim 1, wherein the part of the inner surface layer corresponding to the window area is made of mesh cloth or knitted cloth.

3. The brassiere cup structure of claim 1, wherein the shaping strip is made of a flexible material, and the shaping strip is sandwiched between the outer surface layer and the inner surface layer.

4. The brassiere cup structure of claim 1, further comprises an outer lining cloth layer covering the outer surface layer of the brassiere cup body.

5. The brassiere cup structure of claim 1, wherein a plurality of air holes are provided on the outer surface layer.

6. A manufacturing method of a brassiere cup, comprising: manufacturing a brassiere cup prototype, and removing a certain thickness of material on an outer side of the breast brassiere cup prototype by material removal processing at a junction of a breast supporting part and a lower cling part to obtain the brassiere cup structure of claim 1;

wherein the material removal processing comprises:

cutting the brassiere cup prototype to obtain an outer surface layer, then combining the outer surface layer and the inner surface layer of an elastic cloth.

7. A brassiere cup, comprising the brassiere cup structure of claim 1.

8. The manufacturing method of claim 6, wherein the brassiere cup comprises integrated inner and out surface layers.

9. The manufacturing method of claim 8, wherein the integrated brassiere cup prototype is formed by hot pressing or glue sealing.

10. The manufacturing method of claim 6, the inner and outer surface layers are combined by hot pressing or plastic scaling.

* * * * *